United States Patent [19]

Garbelman et al.

[11] 4,174,181

[45] Nov. 13, 1979

[54] METHOD AND APPARATUS FOR ESTABLISHING AGGREGATE CASCADE ZONES IN AN APPARATUS FOR PRODUCING HOT MIX ASPHALT

[75] Inventors: David L. Garbelman, Edmond; William H. Minor, Bethany; Arthur G. Shaw, Mustang, all of Okla.

[73] Assignee: CMI Corporation, Oklahomo City, Okla.

[21] Appl. No.: 896,512

[22] Filed: Apr. 17, 1978

[51] Int. Cl.[2] ..... B28C 5/20

[52] U.S. Cl. ..... 366/2; 366/25; 366/63; 432/13; 432/118

[58] Field of Search ..... 366/22, 23, 24, 25, 366/26, 27, 33, 57, 58, 59, 62, 2, 7; 432/13, 14, 118

[56] References Cited

U.S. PATENT DOCUMENTS

| | | | |
|---|---|---|---|
| Re.29,496 | 12/1977 | Baldwin | 366/25 |
| 1,240,481 | 9/1917 | Popkess | 366/25 |
| 3,999,743 | 12/1976 | Menpenhall | 366/25 |
| 4,075,710 | 2/1978 | Jakob | 366/25 |
| 4,095,285 | 6/1978 | Malbrunot | 366/23 |

*Primary Examiner*—Robert W. Jenkins

*Attorney, Agent, or Firm*—Dunlap, Codding & McCarthy

[57] ABSTRACT

An improved method and apparatus for producing hot mix asphalt wherein flights provided in a mixer drum for cascading aggregate and asphalt across the mixer drum are constructed to establish a plurality of cascade zones, having differing cascade densities, in different portions of the mixer drum. High density cascade zones are provided to maximize the transfer of heat to aggregate; to shield cooler portions of the drum from hotter portions thereof, and to capture fines which would otherwise pass through the drum.

21 Claims, 17 Drawing Figures

METHOD AND APPARATUS FOR ESTABLISHING AGGREGATE CASCADE ZONES IN AN APPARATUS FOR PRODUCING HOT MIX ASPHALT

CROSS REFERENCES TO RELATED APPLICATIONS

The subject matter of this application is related to the subject matter disclosed in U.S. Patent Application entitled "Improved Method and Apparatus for Producing Hot Mix Asphalt Utilizing Recyclable Asphalt Aggregate", Ser. No. 880,712, filed Feb. 21, 1978, now U.S. Pat. No. 4,147,436, and assigned to the assignee of the present invention.

BACKGROUND OF THE INVENTION

1. Field of the Invention

This invention relates generally to improvements in methods and apparatus for producing hot mix asphalt and more particularly, but not by way of limitation, to methods and apparatus wherein hot mix asphalt is produced from virgin aggregate and a previously manufactured and laid asphalt mix which has been reduced to form recyclable aggregate.

2. Description of the Prior Art

For many years aggregate dryers used in batch type asphalt plants, as well as combination dryers and mixers used in commonly called drum mix asphalt plants, have used flights around the interior of the drum to cascade aggregate through a flame or hot gases for heating, and in drum mix plants to further mix the heated aggregate with asphaltic oil. A typical drum would be tilted downwardly toward the discharge end such that the material moving through the drum may, for example, be maintained in the drum three minutes and the drum may, for example, be rotated about its longitudinal axis at a speed of eight R.P.M. Theoretically, each particle of aggregate would then be lifted by the flighting and cascaded twenty four times while traversing the length of the drum. Historically, except at the extreme ends of the drum, the flighting was designed in the same manner throughout the length of the drum. Thus, if the hot section or zone of the drum (where the flame was present) was about $\frac{1}{8}$ of the length of the drum, the aggregate would be cascaded through the flame only eight times and would be cascaded through hot gases in the remainder of the drum sixteen times. The result has been that what are now considered excessive BTU's are required to adequately dry and heat the aggregate. In a typical drum mixer, the fuel required to dry and heat each ton of aggregate having a moisture content of 5% is 1.65 gallon and the air flow is 125 CFM per ton.

It is also known to produce hot mix asphalt from virgin aggregate and from a recyclable aggregate which has been reclaimed from a previously manufactured and laid hot mix asphalt. As has been described in the above referenced patent application, the new hot mix asphalt can be produced in an apparatus having a rotating mixer drum in which virgin aggregate and recyclable aggregate are mixed with asphaltic oil to produce new hot mix asphalt. In the apparatus described in the aforementioned U.S. patent application, virgin aggregate is introduced into an input end of the drum and dried by a flame which is similarly introduced into the input end of the drum. The recyclable aggregate, which contains asphaltic oil, is introduced at a medial portion of the drum beyond the flame so that decomposition of the asphaltic oil contained in the recyclable aggregate is minimized. Thus, the asphaltic oil used in carrying out such projects as the paving of a roadway or the like is reduced.

In the above mentioned patent application, an improvement in the transfer of heat to the virgin aggregate is obtained by arranging the flighting in the hotter zone of the drum such that the time of exposure of the aggregate to the flame, is increased. That technique is a substantial improvement in heating efficiency and is the forerunner of the present invention.

Another problem also occurs in the operation of an apparatus in which hot mix asphalt is produced in a rotating drum. Virgin aggregate contains small particles, or fines, some of which are not incorporated into the bulk of the hot mix asphalt produced in the drum. The fines which are not incorporated in the mix are carried out of the drum by the secondary air flow and are captured by means of a filtration system for that purpose. It will be clear that to the extent that fines can be incorporated into hot mix asphalt produced in the drum, energy may be saved by reducing the size of such an exhaust fan and materials can be conserved by reducing the quantity of virgin aggregate which has previously been wasted in the preparation of new asphalt.

SUMMARY OF THE INVENTION

In the present invention, a dryer or a combination dryer and mixer drum used for the preparation of hot mix asphalt is provided with means for varying the density of cascading aggregate across the drum. In the hotter section of the drum, the density of the aggregate transversely across the drum and longitudinally along the drum is increased over conventional cascading in a manner to increase the exposure of the aggregate to the heat of and from the flame, whereby the aggregate is heated more effectively and the amount of secondary air required is reduced. In operations conducted with the apparatus to date, the fuel required to dry and heat a ton of aggregate having a moisture content of 5% has been reduced to an average of 1.35 gallons per ton, representing an increase in heating efficiency of about 18%, and the air flow through the drum has been reduced to 105 to 110 C.F.M. per ton. When the invention is used for drum mixing or with the introduction of recycled asphalt, the increased density of the cascading also shields the cooler section of the drum from the hotter section to minimize pollution problems. Moreover, a high density cascade may be provided in a portion of the drum wherein the asphalt is mixed to gather fines such that the exhaust gas will contain less particulate material.

The cascade density in various portions of the drum is adjusted by providing flights used to produce cascading with openings which permit controlled leakage of aggregate, such that a build up of aggregate or mix is produced in portions of the drum where a high density cascade is desired.

An object of the present invention is to increase the efficiency of an apparatus wherein hot mix asphalt is produced in a rotating drum by decreasing thermal heat transfer between portions of the drum wherein drying of aggregate is carried out and portions thereof wherein mixing of the asphalt is carried out.

Another object of this invention is to increase the heating efficiency of an aggregate dryer.

Another object of the present invention is to conserve asphaltic oil used in the production of hot mix asphalt when the mix employs recyclable aggregate.

Still another object of the invention is to conserve materials used in the production of hot mix asphalt by utilizing fines which have previously been removed from the apparatus used in the production of asphalt.

Other objects and advantages of the present invention will be evident from the following detailed description when read in conjunction with the accompanying drawings which illustrate a preferred embodiment of the present invention.

DESCRIPTION OF THE PREFERRED EMBODIMENTS

Figure 1:
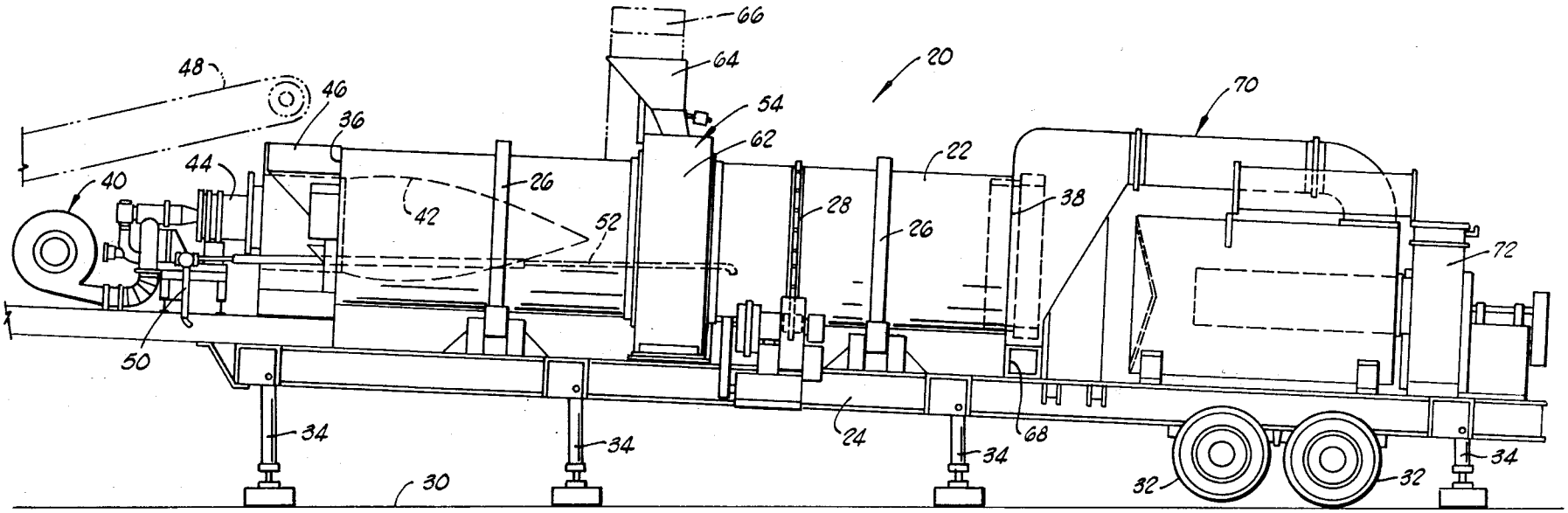
FIG. 1 is a side elevational view of an asphalt mixing apparatus constructed in accordance with the present invention.

Referring now to the diagrams and to FIG. 1 in particular shown therein and designated by the general reference numeral 20 is an asphalt mixing apparatus which may be conveniently utilized to practice the preferred method of the present invention. It is contemplated that the asphalt mixing apparatus 20 will be used to produce hot mix asphalt utilizing virgin aggregate and a previously manufactured and laid asphalt mix which has been reduced in some convenient manner to form recyclable asphalt.

The asphalt mixing apparatus 20 comprises a cylindrical mixer drum 22 which is supported on a frame 24 by plurality of bearing assemblies 26 for rotation about a longitudinal axis of the mixer drum 22 via a conventional chain drive 28. During operation of the asphalt mixing apparatus 20, the frame 24 is supported on the earth's surface 30 via a plurality of jacks 34. The frame 24 is provided with wheels 32 and the jacks 34 can be raised to permit transport of the asphalt mixing apparatus 20 to various locations where asphalt is to be used.

The mixer drum 22 has an input end 36 and an output end 38 and, during operation of the asphalt mixing apparatus 20, the jacks 34 are adjusted such that the longitudinal axis of the mixer drum 22 is disposed along a slant with respect to the horizontal and such that the input end 36 of the mixer drum 22 is higher than the output end 38 thereof. The purpose of positioning the longitudinal axis of the mixer drum 22 along a slant during operation of the asphalt mixing apparatus 20 will be discussed below.

The asphalt mixing apparatus 20 includes a conventional burner assembly 40 mounted on the frame 24 adjacent the input end 36 of the mixer drum 22 and the burner assembly 40 provides a flame 42 in portions of the mixer drum 22 adjacent the input end 36 thereof via a pre-ignition combustion chamber 44. A hopper 46 is mounted on the frame 24 adjacent the input end 36 of the mixer drum 22 and virgin aggregate can be introduced into the mixer drum 22 via the hopper 46 by means of a conventional conveyor assembly 48 as has been indicated in phantom lines in FIG. 1.

A conventional asphaltic oil injection assembly 50 is also mounted on the frame 24 adjacent the input end 36 of the mixer drum 22 with an injection nozzle 52 extending through the input end 36 of the mixer drum 22. The nozzle 52 terminates within the mixer drum 22 at a point therein at which the temperature is sufficiently low to prevent combustion of significant quantities of oil injected into the mixer drum 22 via the nozzle 52 as will be explained in more detail below.

A recyclable aggregate feed assembly 54 is mounted on the frame 24 about a medial portion of the mixer drum 22 and recyclable aggregate can be introduced into the mixer drum 22 via the recyclable feed assembly 54 as disclosed in the aforementioned U.S. Patent Application. In particular, the recyclable aggregate is introduced into the mixer drum 22 via ports 56 (see FIG. 2) formed therein. As described in the aforementioned co-pending U.S. Patent Application, the ports 56 are provided with covers 60 which are hingedly connected to the inner periphery 58 of the mixer drum 22. For clarity of illustration, only one of the covers 60 have been illustrated in FIG. 2. The recyclable aggregate feed assembly 54 also includes a shroud 62 which is disposed about the mixer drum 22 and the interior of the shroud 62 communicates with the interior of the mixer drum 22 via the ports 56 when the covers 60 are in an open position as described in the aforementioned co-pending U.S. Patent Application. A hopper 64 permits the introduction of recycable aggregate into the mixer drum 22 via the shroud 62 and the recyclable aggregate may be fed into the hopper 64 via any suitable conveyor means 66. (The conveyor means 66 has been illustrated in phantom lines in FIG. 1.)

Hot mix asphalt produced within the mixer drum 22 is delivered therefrom via a conventional discharge chute 68 mounted on the frame 24 adjacent the output end 38 of the mixer drum 22. The asphalt mixing apparatus 20 further comprises a dust filtration and collection apparatus 70 of conventional construction and connected to the output end 38 of the mixer drum 22 in any convenient manner. The dust filtration and collection apparatus 70 will normally include an exhaust fan 72 to draw secondary air through the mixer drum 22 in the usual manner.

Figure 2:
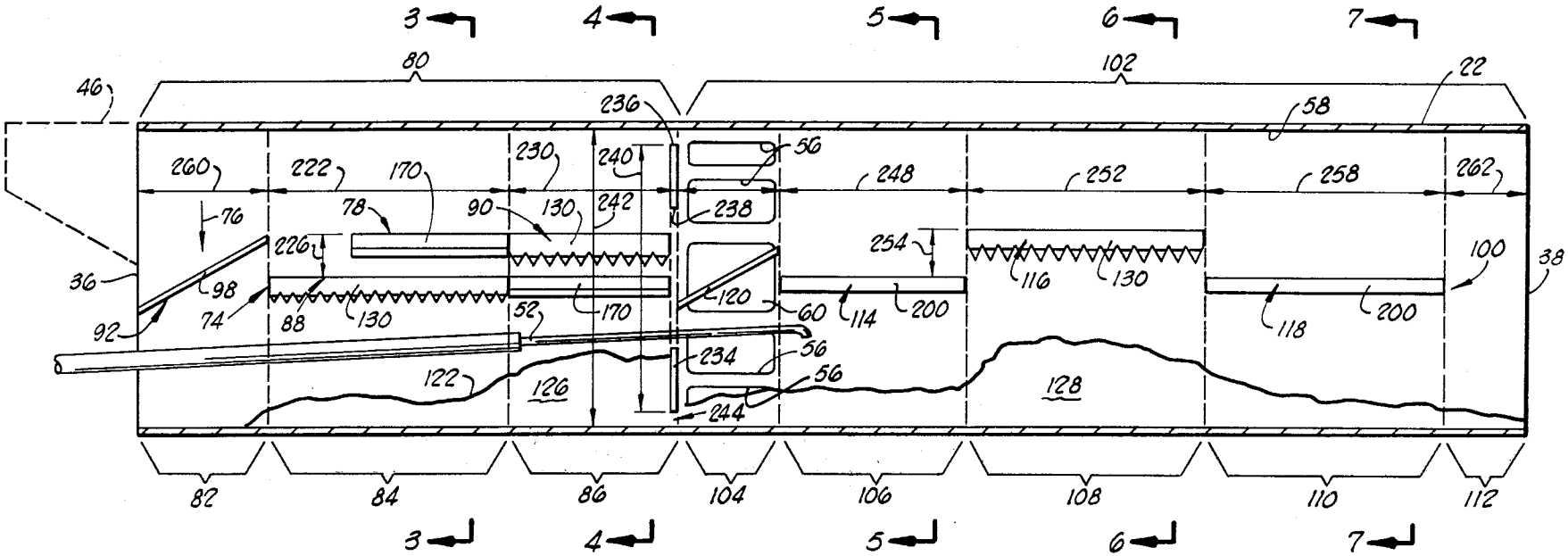
FIG. 2 is a cross section in side elevation of the mixer drum of the asphalt mixing apparatus of FIG. 1.
Figure 3:
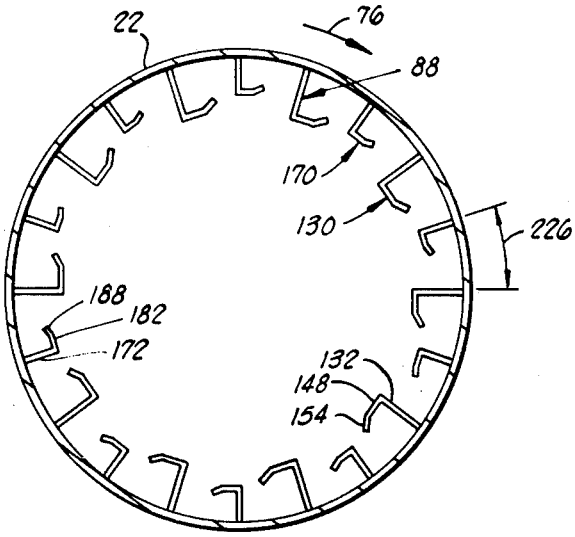
FIG. 3 is a cross section of the mixer drum taken along line 3—3 of FIG. 2.

Referring now to FIG. 2, schematically shown therein is the interior of the mixer drum 22 illustrating a portion of a flight assembly 74 utilized to lift aggregate and/or asphalt mix along the inner periphery 58 of the mixer drum 22 such that the aggregate and/or asphalt mix cascade across the mixer drum 22 as the mixer drum 22 is rotated about the longitudinal axis thereof in a direction 76 (see also FIG. 3).

Figure 4:
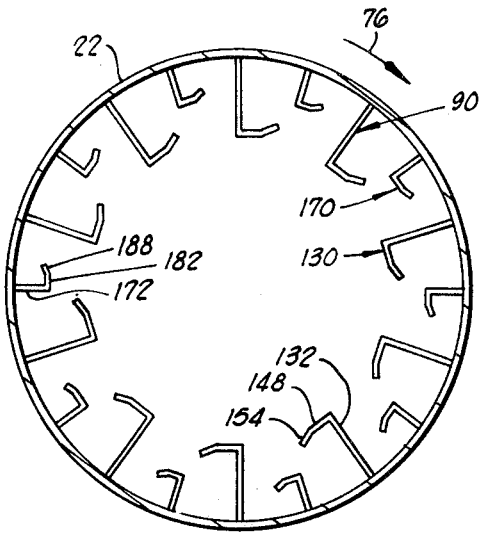
FIG. 4 is a cross section of the mixer drum taken along line 4—4 of FIG. 2.

The flight assembly 74 includes a dryer flight assembly 78 (only a portion of the dryer flight assembly has been illustrated in FIG. 2) disposed in a drying section 80 of the mixer drum 22. As illustrated in FIG. 2, the drying section 80 of the mixer drum 22 and comprises three zones: a spiral flight zone 82, a first drying zone 84, and a second drying zone 86. The flight assembly 74 comprises a low density flight assembly 88 (see also FIG. 3) disposed within the first drying zone 84 and a high density flight assembly 90 (see also FIG. 4) disposed within the second drying zone 86. (For clarity of illustration, only a portion of the low density flight assembly 88 and of the high density flight assembly 90 have been shown in FIG. 2).

A spiral flight assembly 92 is disposed within the spiral flight zone 82 and the spiral flight assembly 92 comprises a plurality of plates 98 (only one plate 98 has been illustrated in FIG. 2) connected to the inner periphery 58 of the mixer drum 22. The plates 98 are connected to the inner periphery 58 of the mixer drum 22 in any convenient manner such as, for example, by welding. The spiral flight assembly 92 accepts virgin aggregate from the hopper 46 and urges the virgin aggregate toward the output end 38 of the mixer drum 22. For this purpose, the plates 98 are disposed at an angle to the longitudinal axis of the mixer drum 22 such that the plates 98 spiral about the inner periphery 58 of the mixer drum 22 in the usual manner of a spiral flight.

Figure 6:
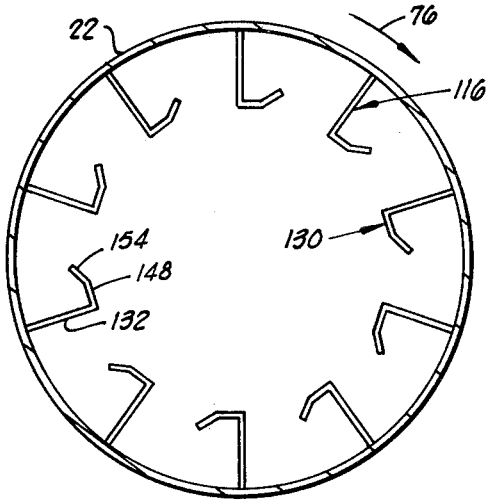
FIG. 6 is a cross section of the mixer drum taken along line 6—6 of FIG. 2.
Figure 7:
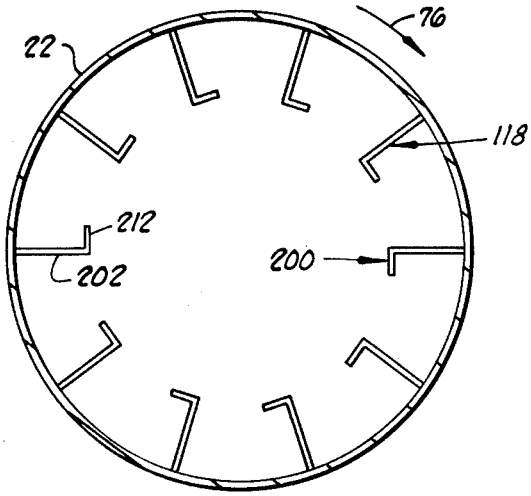
FIG. 7 is a cross section of the mixer drum taken along line 7—7 of FIG. 2.

The flight assembly 74 also includes a mixer flight assembly 100 (only a porton of the mixer flight assembly 100 has been illustrated in FIG. 2) disposed in a mixing section 102 of the mixer drum 22. As illustrated in FIG. 2, the mixing section 102 of the mixer drum 22 is disposed generally adjacent the output end 38 of the mixer drum 22 and comprises five zones: a recycable aggregate input zone 104, a first mixing zone 106, a fine collection zone 108, a second mixing zone 110 and a output zone 112. The mixer flight assembly 100 comprises a first mixing flight assembly 114 (see also FIG. 5) disposed within the first mixing zone 106, a fine collection flight assembly 116 (see also FIG. 6) disposed within the fine collection zone 108 and a second mixing flight assembly 118 (see also FIG. 7) disposed within the second mixing zone 110. (For clarity of illustration, only a portion of each of the assemblies 114, 116 and 118 have been shown in FIG. 2).

The ports 56 providing access to the mixer drum 22 for the recyclable aggregate are located in portions of the periphery 58 of the mixer drum 22 within the recyclable aggregate input zone 104 and, as has been described in the aforementioned co-pending U.S. Patent Application, the covers 60 for the pots 56 are provided with plates 120 which coact to form a spiral flight within the recyclable aggregate input zone 114. (Only one cover 60 and one plate 120 have been illustrated in FIG. 2).

The output zone 112 is provided with a plurality of paddles (not shown) as is shown in the art to urge mixed asphalt into the discharge chute 68.

As is further illustrated in FIG. 2, the drying section 80 of the mixer drum 22 meets the mixing section 102 thereof in a medial portion of the mixer drum 22 such that the second drying zone 86, containing the high density flight assembly 90, is adjacent the mixing section 102 of the mixer drum 22 for a purpose to be discussed more fully below. The junction nozzle of the asphaltic oil injection assembly 50 terminates adjacent the recyclable aggregate input zone 104 such that asphaltic oil may be introduced into portions of the mixing section 102 nearest the input end 36 of the mixer drum 22.

Also shown schematically, in FIG. 2 is a profile 122 of aggregate and asphalt mix along lower portion of the mixer drum 22 during operation of the asphalt mixing plant 20. It will be noted that a build up 126 of aggregate in lower portions of the mixer drum occurs in the second drying zone 86 and that a build up 128 of asphalt mix in lower portions of the mixer drum 22 occurs in the fine collection zone 108 during operation of the asphalt mixing apparatus 20.

Figure 10:
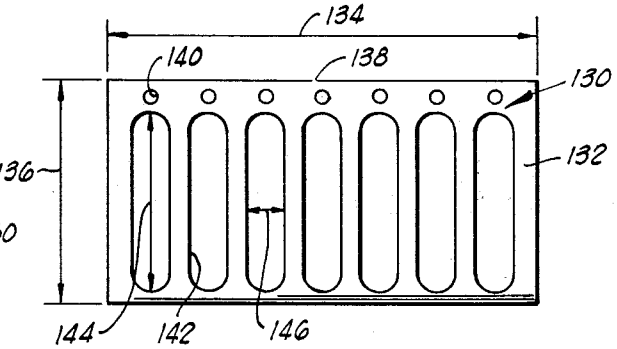
FIG. 10 is a plan view of the flight of FIG. 8.
Figure 9:
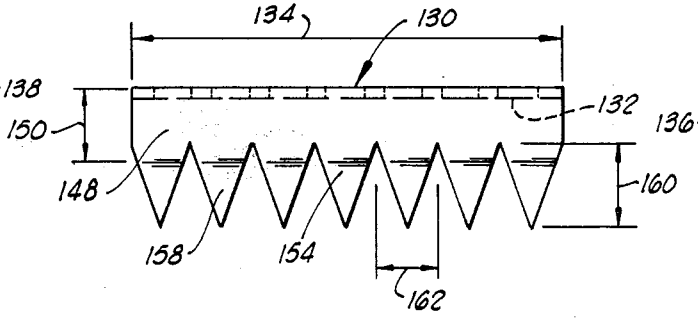
FIG. 9 is a front elevational view of the flight of FIG. 8.
Figure 8:
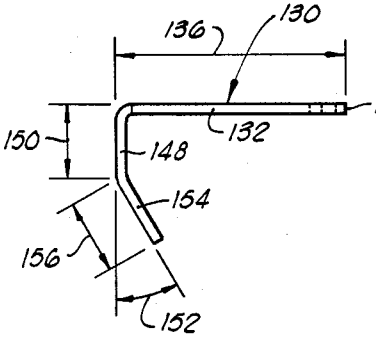
FIG. 8 is an end elevational view of one type of flight used in the mixer drum.

The flight assembly 74 is constructed using individual flights having one of the three forms illustrated in FIGS. 8 through 12. In FIGS. 8 through 10, there is illustrated what may be called a type I flight 130 which is incorporated into the low density flight assembly 88, the high density flight assembly 90 and the fine collection flight assembly 116. As will be discussed hereinbelow, the dimensions of features of the type I flight assembly 130 are adjusted for incorporation into the flight assemblies 88, 90 and 116 to cause the build up of aggregate in the second drying zone 86 and the build up of asphalt mix in the fine collection zone 108 as noted above.

The type I flight 130 is constructed of sheet steel and is bent into the general configuration illustrated in FIG. 8. In particular, the type I flight 130 includes a base portion 132 having a length 134 (FIG. 9) and a width 136 (FIG. 8). The base portion 132 terminates along one side in an edge 138 and the edge 138 abuts the inner periphery 58 of the mixer drum when the flight 130 is incorporated into the asphalt mixing apparatus 20. The base portion 132 has a plurality of holes 140 (FIG. 10) formed adjacent the edge 138 and the flight 130 is attached to the mixer drum 22 by bolting the base portion 132 to a section of angle iron (not shown) welded to the inner periphery 58 of the mixer drum 22. The angle iron (not shown) is similarly provided with a plurality of holes for this purpose.

The base portion 132 is also provided with a plurality of openings, preferably in the form of enlongated slots 142 formed generally transversely to the length 134 of the base portion 132. The slots 142 are symmetrically disposed along the base portion 132 and each slot 142 has a preselected length 144, generally parallel to the width 136 of the base portion 132 and a preselected width 146 disposed generally parallel to the length 134 of the base portion 132.

Opposite the edge 138 of the base portion 132, the flight 130 is bent to form a riser portion 148 having a width 150 and being discussed away from the inner periphery 58 of the mixer drum 22 when the flight 130 is mounted thereon. The riser portion 148 extends substantially perpendicularly from the base portion 132 and the flight 130 is further bent at a preselected angle 152 at the distal end of the riser portion 148 to form a cup portion 154 which extends away from the riser portion 148 in a direction generally toward the edge 138 of the base portion 132. That is, the cup portion 154 extends generally away from the riser portion 148 toward the inner periphery 58 of the mixer drum 22 when the flight 130 is mounted within the mixer drum 22. The cup portion 154 extends generally a distance 156 from the end of the riser portion 148 opposite the base portion 132; that is, the cup portion has a width designated by the numeral 156. It is noted that the lengths of the riser portion 148 and the cup portion 154 are substantially the same as the length 134 of the base portion 132 so that the length 134 of the base portion 132 defines the length of the flight 130. Accordingly the length 134 will sometimes be referred to herein as the length of the flight 130.

As illustrated in FIG. 9, a plurality of triangular teeth 158 are formed in the flight 130, the teeth 158 extending through the cup portion 154 and terminating at a preselected position within the riser portion 148. In one preferred embodiment of the present invention, the dimensions of the teeth 158 have been standardized such that the height 160 of each tooth along the cup portion 154 and portions of the riser portion 148 is selected to be four inches. Similarly, the width 162 of each tooth 158 has been standardized at three inches for the one preferred embodiment of the present invention.

Figure 11:
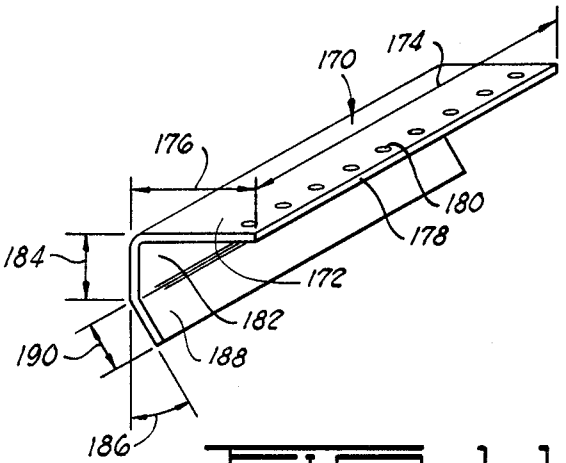
FIG. 11 is an isometric view of a second type of flight used in the mixer drum.

Illustrated in FIG. 11 is a second type of flight 170 used in the flight assembly 74 and referred to herein as a type II flight. The type II flight 170 has a base portion 172 having a length 174 and a width 176. One side of the base portion 172 terminates in an edge 178 which, in the assembled mode of the asphalt mixing apparatus 20, engages the inner periphery 58 of the mixer drum 22. A plurality of holes 180 are formed in the base portion 172 adjacent the edge 178 such that the type II flight 170 may be attached to the inner periphery of the mixer drum 22 in the same manner that the type I flight 130 is attached thereto. Opposite the edge 178, the type II flight 170 is bent substantially at a right angle to form a riser portion 182 of the type II flight 170. The riser portion 182 has a width 184 and the type II flight 170 is bent at a preselected angle 186 to form a cup portion 188 extending from the riser portion opposite the intersection of the riser portion 182 with the base portion 172. The cup portion 188 has a width 190 and the type II flight 170 is bent such that the cup portion 188 extends from the riser portion 182 generally toward the inner periphery 58 of the mixer drum 22 in an assembled mode of the asphalt mixing apparatus 20. It is noted that the lengths of the riser portion 182 and the cup portion 188 are substantially the same as the length 174 of the base portion 172 such that the length 174 of the base portion 172 defines the length of the flight 170. Accordingly, the length 174 will sometimes be referred to herein as the length of the flight 170.

Figure 12:
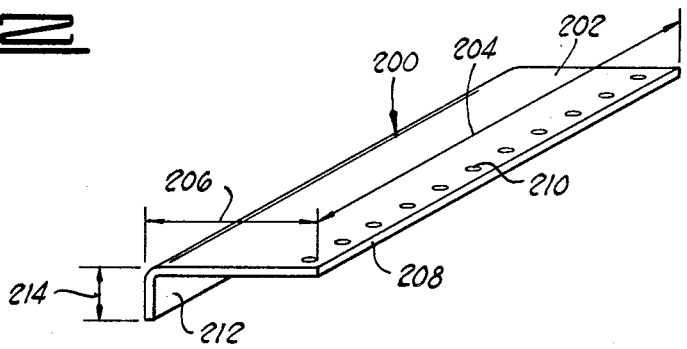
FIG. 12 is an isometric view of a third type of flight used in the mixer drum.

FIG. 12 illustrates a third type of flight 200 used in the construction of the flight assembly 74 and referred to herein as a type III flight. The flight 200 comprises a base portion 202 having a length 204 and a width 206. The base portion 202 terminates along one side thereof in an edge 208 which engages the inner periphery 58 of the mixer drum 22 when the flight 200 is mounted in the mixer drum 22. A plurality of holes 210 are formed adjacent the edge 208 such that the flight 200 can be mounted within the mixer drum 22 in the same manner that the flights 130 and 170 are mounted therein.

Opposite the edge 208, the type III flight 200 is bent at substantially a right angle to form a riser portion 212 having a preselected width 214. It is noted that the length of the riser portion 212 is substantially the same as the length 204 of the base portion 202 so that the length 204 defines the length of the flight 200. Accordingly, the length 204 will sometimes be referred to herein as the length of the flight 200.

The low density flight assemby 88 (FIG. 2) is constructed of a plurality of type I flights 130 and type II flights 170 mounted within the first drying zone 84 as illustrated in FIGS. 2 and 3. The base portions 132 of the flights 130 are attached to the inner periphery 58 of the mixer drum 22 and extend therefrom substantially perpendicularly. As illustrated in FIG. 2, the lengths 134 of the flights 130 are selected such that the flights extend along the inner periphery 58 the entire length 222 of the first drying zone 84. More particularly, the lengths 134 of the flights 130 define the length 222 of the first drying zone 84. As shown in FIG. 3, the flights 130 are angularly spaced about the periphery 58 a symmetric array about the longitudinal axis of the mixer drum 22. As is further illustrated in FIG. 3, the flights 130 are positioned such that the riser portion 148 of each flight 130 extends from the base portion 132 thereof generally in the direction 76 in which the mixer drum 22 is rotated during operation of the asphalt mixing apparatus 20.

The low density flight assembly 88 further comprises a plurality of flights 170. The number of flights 170 is equal to the number of flights 130 and the base portions 172 of the flights 170 are attached to the inner periphery 58 of the mixer drum 22 and extend therefrom substantially perpendicularly. As illustrated in FIG. 2, the lengths of the flights 170 are substantially shorter than the length 222 of the first drying zone 84 and the flights 170 are positioned within the first drying zone 84 in portions thereof disposed farthest from the input end 36 of the mixer drum 22 such that the flights 170 are located adjacent the second drying zone 86. The flights 170 are circumferentially offset from the flights 130 along the periphery 58 of the mixer drum 22 by a preselected arc length 226. As shown in FIG. 3, the arc length 226 is selected such that the base portion 172 of each flight 170 is symmetrically positioned between the base portions 132 of two successive flights 130. Accordingly, the flights 130 and the flights 170 are angularly positioned along the inner periphery 58 of the mixer drum 22 such that the low density flight assembly 88 forms a symmetric array about the longitudinal axis of the mixer drum 22. As is further illustrated in FIG. 3, the riser portion 182 of each flight 170 extends from the base portion 172 thereof generally in the direction 76 in which the mixer drum 22 is rotated during operation of the asphalt mixing apparatus 20.

The high density flight assembly 90 is similarly constructed of a plurality of type I flights 130 and type II flights 170. The base portions 132 of the flights 130 are attached to the inner periphery 58 of the mixer drum 22 as previously described and the base portions 132 extend substantially perpendicularly from the inner periphery 58 of the mixer drum 22. As shown in FIG. 2, the length of each flight 130 is slightly smaller than the length 230 of the second drying zone 86 and each flight 130 abuts a flight 170 of the low density flight assembly 88. The number of flights 130 of the high density flight assembly 90 is equal to the number of flights 130 of the low density flight assembly 88. As shown in FIG. 2, each flight 130 of the assembly 90 is angularly positioned on the periphery 58 of the mixer drum 22 such that the base portion 132 thereof is longitudinally aligned with the base portion 172 of a flight 170 of the low density flight assembly 88. Accordingly, the flights 130 of the high density flight assembly 90 are formed into a symmetric array about the longitudinal axis of the mixer drum 22 as has been illustrated in FIG. 4. As is further shown in FIG. 4, the riser portion 148 of each flight 130 extends from the base portion 132 thereof generally in the direction 76 in which the mixer drum 22 is rotated during operation of the asphalt mixing apparatus 20.

As has been previously noted, the dimensions of features of the type I flights 130 incorporated into different flight assemblies such as the low density flight assembly 88 and the high density flight assembly 90 differ from one flight assembly to another flight assembly. A significant difference between the flights 130 of the high density flight assembly 90 and the flights 130 of the low density flight assembly 88 is that the lengths 144 (FIG. 10) of the slots 142 formed in the base portions 132 of the flights 130 of assembly 90 are longer than the corresponding slot lengths 144 for the flights 130 of assembly 88.

The high density flight assembly 90 further includes a plurality of flights 170. In one preferred embodiment of the asphalt mixing apparatus 20, each flight 170 of the high density flight assembly 90 is substantially identical to the flights 170 of the low density flight assembly 88. Moreover, the length 174 of each flight 170 of assembly 90 is substantially identical to the length 134 of each flight 170 of assembly 88. The base portions 172 of the flights 170 of assembly 90 are attached to the inner periphery 58 of the mixer drum 22 as has been previously described and the base portions 172 of the flights 170 of assembly 90 extend therefrom substantially perpendicularly into the interior of the mixer drum 22. The number of flights 170 in assembly 90 is equal to the number of flights 130 of the low density flight assembly 88. As shown in FIG. 2, each flight 170 of assembly 90 is angularly positioned on the inner periphery 58 of the mixer drum 22 such that the base portion 172 of each such flight 170 is longitudinally aligned with the base portion 132 of a flight 130 of the low density flight assembly 88. Accordingly, the flights 170 of assembly 90 form a symmetric array about the longitudinal axis of the mixer drum 22 as has been shown in FIG. 4. As is further shown in FIG. 4, the riser portion 182 of each flight 170 of assembly 90 extends from the base portion 172 thereof generally in the direction 76 in which the mixer drum 22 rotates during operation of the asphalt mixing apparatus 20.

The high density flight assembly 90 further comprises a ring 234 constructed of sheet steel and attached to the flights 130 and flights 170 of the high density flight assembly 90 at the boundary between the drying section 80 and the mixing section 102 of the mixer drum 22 such that the length of the flights 130 and the thickness of the ring 234 define the length 230 of the second drying zone 86. The ring 234 can be conveniently attached to the flights 130 and 170 by welding or bolting the ring 234 thereto. The ring 234 has an outer periphery 236 and an inner periphery 238 and the peripheries 236 and 238 are disposed substantially concentrically with the inner periphery 58 of the mixer drum 22. The outer diameter 240 of the ring 234 is smaller than the inner diameter 242 of the mixer drum 22 such that a space 244 is formed between the outer periphery 236 of the ring 234 and the inner periphery 58 of the mixer drum 22 to permit aggregate to pass from the drying section 80 to the mixing section 102 via the space 244.

Figure 5:
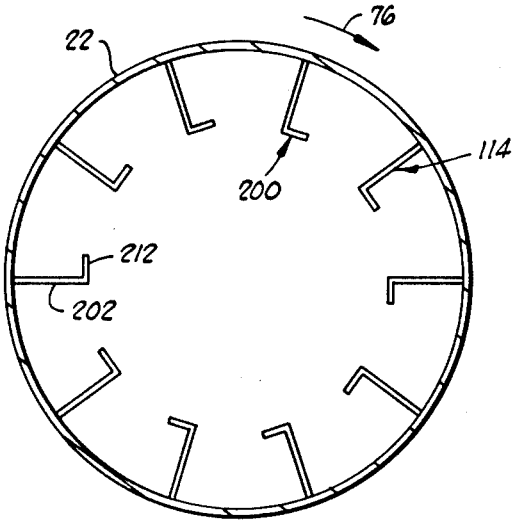
FIG. 5 is a cross section of the mixer drum taken along line 5—5 of FIG. 2.

The first mixing flight assembly 114 comprises a plurality of type III flights 200. The base portions 202 of the flights 200 are connected to the inner periphery 58 of the mixer drum 22 in the manner previously described and extend therefrom substantially perpendicularly into the interior of the mixer drum 22 as has been shown in FIG. 5. The length of the flights 200 are selected such that the flights 200 extend substantially the entire length 248 of the first mixing zone 106. The number of flights 200 is equal to the number of flights 130 in the first drying zone 84 and each flight 200 is circumferentially positioned on the inner periphery 58 of the mixer drum 22 such that the base portion 202 thereof is longitudinally aligned with the base portion 132 of one of the flights 130 of the low density flight assembly 88. Accordingly, as shown in FIG. 5, the positioning of the flights 200 is such to form the first mixing flight assembly 114 into a symmetric array about the longitudinal axis of the mixer drum 22. As is also shown in FIG. 5, the riser portion 212 of each flight 200 extends from the base portion 202 thereof generally in the direction 76 in which the mixer drum 22 rotates during operation of the asphalt mixing apparatus 20.

The fine collection flight assembly 116 comprises a plurality of type I flights 130. The base portions 132 of the flights 130 are connected to the inner periphery 58 of the mixer drum 22 and extend therefrom substantially perpendicularly into the interior of the mixer drum 22 as has been shown in FIG. 6. The lengths 134 of the flights 130 of assembly 116 are selected such that the flights 130 extend substantially the entire length 252 of the fine collection zone 108 as has been shown in FIG. 2. The number of flights 130 of assembly 116 is equal to the number of flights 200 in the first mixing zone 106 and the flights 130 are circumferentially positioned on the inner periphery 58 of the mixer drum 22 such that the base portion 132 of flight 130 is angularly offset by an arc length 254 from the base portion 202 of a flight 200 of assembly 114 as has been illustrated in FIG. 2. The arc length 254 is substantially the same as the arc length 226 by which the flights 170 are offset from the flights 130 in the low density flight assembly 88 so that the base portion 132 of each flight 130 of assembly 116 is longitudinally aligned with the base portion 172 of a flight 170 of the low density flight assembly 88. Accordingly, as has been shown in FIG. 6, the positioning of the flights 130 on the inner periphery 58 of the mixer drum 22 is such to form the fine collection flight assembly 116 into a symmetric array about the longitudinal axis of the mixer drum 22. As has been further shown in FIG. 6, the riser portion 148 of each flight 130 extends from the base portion 132 thereof generally in the direction 76 in which the mixer drum 22 rotates during operation of the asphalt mixing apparatus 20.

It has been previously noted that the dimensions of features of flights incorporated into different flight assemblies differ from one flight assembly to another flight assembly. A significant difference between the flights 130 of assembly 116 and the flights 130 of assembly 90 and flights 130 of flight assembly 88 is that the widths 146 of the slots 142 formed in the base portions 132 of the flights 130 of assembly 116 are greater than the widths 146 of the corresponding slots 142 formed in the base portions 132 of the flights 130 in the assemblies 88 and 90.

The second mixing flight assembly 118 comprises a plurality of type III flights 200. The flights 200 are connected to the inner periphery 58 of the mixer drum 22 in the manner previously described and extend therefrom substantially perpendicularly into the interior of the mixer drum 22 as has been shown in FIG. 7. The lengths 204 of the flights 200 of assembly 118 are selected such that such flights extend substantially the entire length 258 of the second mixing zone 110. The number of flights 200 of assembly 118 is equal to the number of flights 200 in the first mixing zone 106 and such flights are aligned. Accordingly, as has been shown in FIG. 7, the positioning of the flights 200 is such to form the second mixing flight assembly 118 into a symmetric array about the longitudinal axis of the mixer drum 22. As is further shown in FIG. 7, the riser portion 212 of each flight 200 extends from the base portion 202 thereof generally in the direction 76 in which the mixer drum 22 rotates during operation of the asphalt mixing apparatus 20.

As has been discussed in the aforementioned co-pending application, a flame deflector or heat shield (not shown) may be provided within the mixer drum 22 generally in medial portions thereof and generally positioned along the longitudinal axis thereof.

It will perhaps be useful at this point to provide a detailed description of the dimensions of the mixer drum 22 and the flight assembly 74 of an asphalt mixing apparatus 20 which has been constructed in accordance with the present invention and which is designed to process in excess of 150 tons of virgin aggregate and recyclable aggregate into new hot mix asphalt per hour. The length of the mixer drum 22 of the one preferred embodiment is approximately 26 feet and the diameter 242 of the inner periphery 58 thereof is approximately six feet. the chain drive 28 is constructed to rotate the mixer drum 22 a approximately 9 R.P.M. and the burner assembly 40 introduces heat into the input end 36 at a maximum rate of approximately 50 million B.T.U.'S per hour. The exhaust fan 72 is designed and operated such that a secondary air flow of approximately 26,000 actual cubic feet per minute is drawn through the interior of the mixer drum 22.

In the said one preferred embodiment, the spiral flight zone 82 has a length of approximately two feet six inches; the first drying zone 84 has a length of approximately four feet five inches; the second drying zone 86 has a length of approximately two feet three and three-quarter inches; the first mixing zone 106 has a length of approximately three feet seven inches; the fine collection zone 108 has a length of approximately four feet five inches; the second mixing zone 110 has a length of approximately four feet five inches and the output zone 112 has a length of approximately one foot five inches.

The low density flight assembly 88 of the said one preferred embodiment comprises ten flights 130 and ten flights 170 symmetrically spaced about the inner periphery 58 of the mixer drum 22. The flights 130 of assembly 88 are constructed of five-sixteenths inch thick sheet steel and the lengths 134 thereof are approximately four feet and five inches. The widths 136 of the base portions 132 of such flights 130 are each approximately eight and one quarter inches and the base portions 132 are each provided with fourteen slots 142 which are evenly spaced over a central portion of the base portion 132. Each slot 142 in each such flight 130 has a length 144 of approximately seven inches and a width 146 of approximately one inch and the length 144 of each slot 142 is substantially centered with respect to the width 136 of the base portion 132.

The width 150 of the riser portion 148 of each flight 130 of assembly 88 is approximately four inches and the width 156 of the cup portion 154 thereof is approximately two and one half inches. The angle 152 between the cup portion 154 and the riser portion 148 is approximately 30°. As has been previously stated, the teeth 158 in the type I flights 130 used in the one preferred embodiment have been standarized at a depth 160 of four inches and a width 162 of three inches. The teeth 158 extend substantially the entire length 134 of each such flight 130.

The flights 170 of assembly 88 in the said one preferred embodiment are constructed of one quarter inch thick sheet steel and the lengths 174 thereof are approximately two feet and eleven inches. The widths 176 of the base portions 172 are approximately five inches; the widths 184 of the riser portions 182 are approximately three inches and the widths 190 of the cup portions 188 are approximately two inches. The angle 186 between the cup portion 188 and the riser portion 182 is approximately 15°.

The high density flight assembly 90 in the said one preferred embodiment of the asphalt mixing apparatus 20 comprises ten flights 130 and ten flights 170 symmetrically spaced about the inner periphery 58 of the mixer drum 22 as has been previously described. The flights 130 are constructed of one quarter inch thick sheet steel and the lengths 134 thereof are approximately two feet and eleven inches. The widths 136 of the base portions 132 of the flights 130 are each approximately twelve inches and the base portions 132 are each provided with nine slots 142 which are evenly spaced over a central portion of the base portion 132 having an extent of approximately two feet and four inches. Each slot 142 in each flight 130 has a length 144 of approximately nine inches and a width 146 of approximately one inch and the length 144 of each slot 142 is substantially centered with respect to the width of the base portion 132.

The width 150 of the riser portion 148 of each flight 130 of assembly 90 is approximately four inches and the width 156 of the cup portion 154 thereof is approximately three and one-half inches. The angle 152 between the cup portion 156 and the riser portion 148 is approximately 15°. The teeth 158 formed in the cup portion 154 and the riser portion 148 have the same dimensions in the flight 130 of assembly 90 as in the flight 130 of assembly 88 and the teeth 158 extend substantially the entire length 134 of the flights.

In the said one preferred embodiment of the present invention, the flights 170 of assembly 90 are substantially identical to flights 170 of assembly 88.

The ring 234 forming a portion of the high density flight assembly 90 is constructed of one-quarter inch thick sheet steel and has an outer diameter 240 of approximately sixty-one and three-eighths inches and an inner diameter (not designated in the drawings) of approximately thirty and eleven-sixteenths inches.

The first and second mixing flight assemblies, 114 and 118 respectively, each comprise ten type III flight assemblies 200 constructed of one-quarter inch thick sheet steel. The flights 200 in assembly 114 in the said one preferred embodiment of the asphalt mixing apparatus 20 each have a length of approximately three feet and seven inches and the width 206 of the base portions 202 thereof are each approximately twelve inches. The width 214 of the riser portion 212 of each flight 200 of assembly 114 is approximately four inches. The flights 200 of assembly 118 differ from the flights 200 of assembly 114 only in that the lengths 204 of the former are approximately four feet and five inches long rather than three feet and seven inches.

The fine collection flight assembly 116 in the said one preferred embodiment of the asphalt mixing apparatus 20 comprises ten flights 130, each of which is constructed of one-quarter inch sheet steel. The length 134 of each flight 130 of assembly 116 is approximately four feet and five inches and the width 136 of the base portion 132 thereof is approximately 12 inches. Each slot 142 in each such flight 130 has a length 144 of approximately nine inches and a width 146 of approximately two inches. The length 144 of each slot 142 is substantially centered with respect to the width 136 of the base portion 132.

The width 150 of the riser portion 148 of each flight 130 of assembly 116 is approximately four inches and the width 156 of the cup portion 154 thereof is approximately three and one-half inches. The angle 152 between the cup portion 154 and the riser portion 148 is approximately 30°. The cup portion 154 and the riser portion 148 are provided with teeth 158 having the dimensions previously described and extending substantially the entire length 134 of the flight.

OPERATION OF THE PREFERRED EMBODIMENT

In the operation of the apparatus 20, the drum 22 (FIG. 1) is rotated about its longitudinal axis by means of the drive chain 28 while the burner assembly 40 produces the flame 42 extending from the input end 36 of the drum 22 to an intermediate point in the drum, and the exhaust fan 72 is operated to draw secondary air into the input end 36 of the drum 22 around the combustion chamber 44 to provide the necessary air for supporting combustion in the flame 42 and provide a means for withdrawing steam and the products of combustion (collectively known as exhaust gases) from the drum 22 into the dust collection system 70. As previously indicated, virgin aggregate is supplied by the conveyor 48 into the hopper 46 to enter the input end 36 of the drum 22 radially around the flame 42. Also, particulated, previously laid asphalt mix is fed by the conveyor 66 into the hopper 64 to enter the medial portion of the drum 22 and asphaltic oil is injected through the nozzle 52 into an intermediate portion of the drum 22 downstream from the terminal end of the flame 42 and downstream from the zone 104. It will be understood by those skilled in the art that since the input end 36 of the drum 22 is higher than the output end 38, all of the material fed to the drum 22 will gravitate toward the discharge end 38 of the drum.

Figure 14:
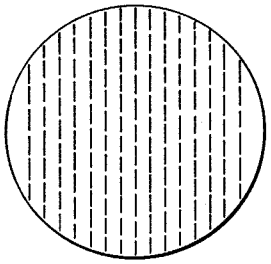
FIG. 14 is a schematic transverse cross section through a drum illustrating a more dense cascading.
Figure 16:
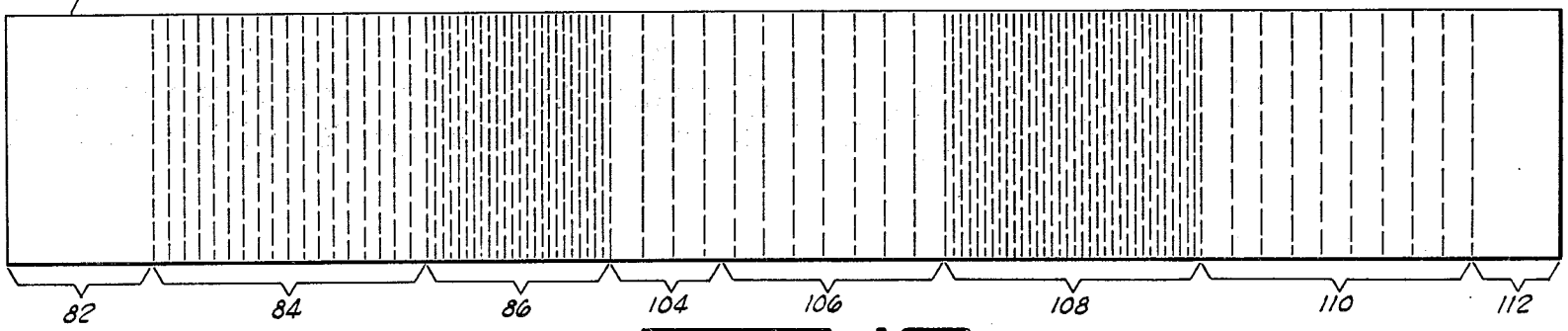
FIG. 16 is a schematic longitudinal cross section through a drum illustrating the variation in density of cascading material along the drum which may be obtained with one form of this invention.

The virgin aggregate fed into the input end 36 of the drum is initially moved by the flights 92 (FIG. 2) around the flame 42 with an insignificant amount of the virgin aggregate being dropped or cascaded through the flame 42. The spiral flights 92 assist the force of gravity in moving the virgin aggregate into the zone 84 of the drum 22 where the flighting 130 and 170 moves the virgin aggregate upwardly and around a medial portion or intermediate portion of the flame 42 while simultaneously cascading the virgin aggregate through and around the flame 42. The density of the virgin aggregate cascaded around and through the flame 42 in the zone 84 of the drum is schematically illustrated in FIGS. 14 and 16. The density of the cascaded material in this zone of the drum is somewhat greater than the normally expected cascading in conventional dryers and drum mix plants and may be considered an intermediate density. In this zone 84 of the drum, the virgin aggregate is repeatedly cascaded across the drum through and around the intermediate portion of the flame 42 to expose the aggregate to appreciable heat by direct contact with the flame, as well as by radiation and by convection.

As the virgin aggregate gravitates into the zone 86 of the drum 22, the flighting 130 and 170 in this zone of the drum also moves the material around the drum while simultaneously cascading the aggregate through and around the terminal end portion of the flame 42. As previously indicated, the flighting 130 in the zone 86 of the drum is larger and has larger openings therein, such that the density of the aggregate being cascaded through and around the terminal end portion of the flame 42 will be increased in density as indicated schematically in FIGS. 15 and 16. The increased density of the cascading aggregate exposes the aggregate to the maximum direct contact with the flame 42 to provide the maximum heating of the aggregate in this zone of the drum, and the increased density further serves the purpose of limiting the length of the flame 42 to the desired portion of the drum. Here again, the aggregate is repeatedly cascaded around and through the flame 42 in the zone 86 of the drum.

As the virgin aggregate gravitates into the zone 104 of the drum, the virgin aggregate is joined by the particulated, previously laid asphalt mix being fed through the hopper 64 and openings 56 (FIGS. 1 and 2) and is then joined by the asphaltic oil being injected through the nozzle 52. The flighting 120 on the covers 60 for the ports 56 assist the force of gravity in moving all of these materials on toward the discharge end 38 of the drum and a modest amount of these materials will be cascaded across the drum in this zone 104. As these materials gravitate into the zone 106 of the drum, the materials are mixed by being lifted by the flighting 200 much in the manner of a coonventional dryer or drum mix apparatus whereby the materials will be cascaded across the major portion of the drum and will be mixed together. The limited density of the materials cascaded across the drum in the zone 106 is schematically illustrated in FIGS. 13 and 16.

Figure 15:
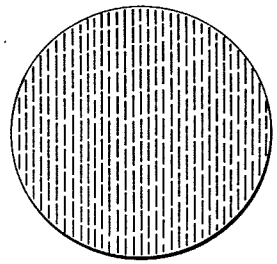
FIG. 15 is a schematic transverse cross section through a drum illustrating a still more dense cascading.

As the mixture gravitates into the zone 108 of the drum 22, the materials are lifted by the flighting 130 in this zone of the drum and are cascaded across essentially the entire cross-section of the drum, much in the same manner as the cascading in the zone 86 previously described, and as schematically illustrated in FIGS. 15 and 16. The mixture is repeatedly cascaded across the drum in this zone 108 with the mixture being at an increased density to form a filter across the drum and trap fine particulate material being carried through the drum by the secondary air and products of combustion, thereby materially decreasing the amount of particulate material which finally reaches the discharge end of the drum and has to be removed by the dust collection system 70.

Figure 13:
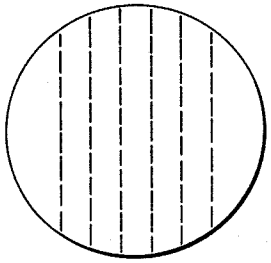
FIG. 13 is a schematic transverse cross section through a drum illustrating the cascading in a typical drum.

As the mixture gravitates on into the zone 110 of the drum 22, the mixture is again lifted by the flighting 200 in this zone of the drum and repeatedly cascaded across the major portion of the cross-section of the drum much in the same manner as in the zone 106 previously described, and as illustrated in FIGS. 13 and 16, to provide a further mixing of the virgin aggregate, the particulated, previously laid asphalt mix and the fresh asphaltic oil introduced through the nozzle 52.

This mixture then enters the zone 112 of the drum 22 where it is discharged into and through the discharge chute 68 where it is available for use in conventional hot mix laydown operations.

As previously indicated, testing of an apparatus constructed as illustrated in FIGS. 1 through 16 has shown a marked increase in fuel consumption efficiency over a conventional drum mix apparatus.

Figure 17:
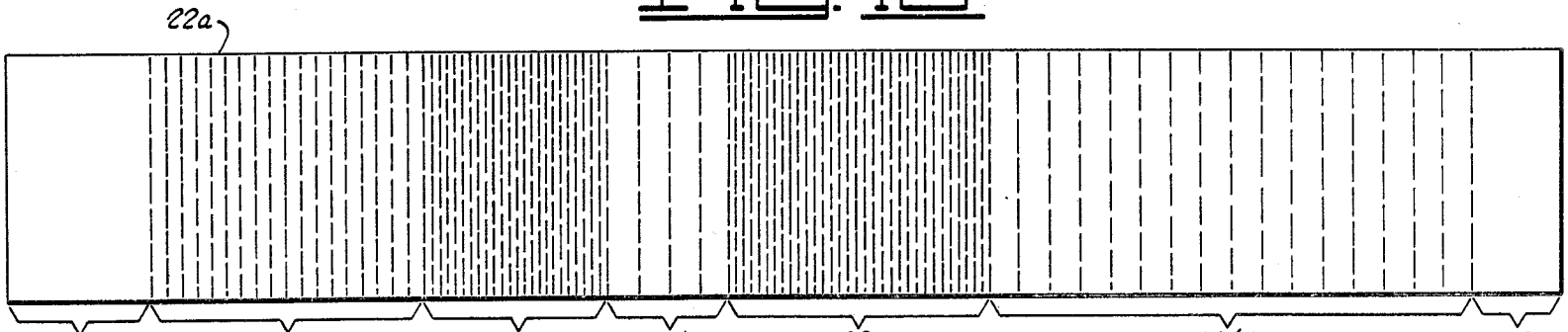
FIG. 17 is an illustration similar to FIG. 16 illustrating another variation in density of cascading material along a drum which may be obtained with this invention.

It will be understood by those skilled in the art that the flighting in the various zones of the drum may be shifted somewhat to relocate the more dense cascading zones, if desired. For example, as illustrated in FIG. 17, the more dense cascading zone of the mixture of virgin aggregate, particulated previously laid asphalt mix and fresh asphaltic oil may be provided immediately downstream of the zone 104 of the drum into the zone 108 indicated in FIG. 17. The remaining portion of the drum 22 downstream from this point may then be employed for further mixing similar to the zones 106 and 110 previously described.

In practice of this invention it is important to distribute the aggregate entirely across the drum 22 in the zone 86 in as uniform a manner as possible, as illustrated in FIG. 15, and as contrasted with its more conventional cascading as illustrated in FIG. 13. When the more conventional cascading is used, the aggregate has less exposure to the flame and spaces exist between the cascading aggregate and the sides of the drum as illustrated in FIG. 13, forming what may be considered a short circuit for exhaust gases. With a substantially uniform distribution of the aggregate all the way across the drum, the aggregate is more completely exposed to the flame and the hot secondary air and products of combustion for maximized heating.

The distribution of aggregate across the drum can be determined when a particular aggregate is being used in order that changes can be made in the size and/or openings in the flighting to obtain the desired distribution. This can be done by removing end plates from the drum, running aggregate through the drum without operation of the burner and visually observing the conditions.

The density of the dense cascade zone 86 for the most efficient operation will vary with the size of the aggregate, among other things. Generally, the more coarse the aggregate, the more dense the zone 86 needs to be. The primary indication that the zone 86 is not dense enough will be indicated by the appearance of smoke in the exhaust gases indicating that too much heat is penetrating the zone 86 and burning either the fresh asphaltic oil or hydrocarbon on the recycle aggregate being fed into the zone 104. If smoke appears, the density in the zone 86 should be increased until the smoke disappears.

Similar considerations apply to the dense cascade zone 108 and the density of the zone 108 may be increased or decreased at desired to trap the necessary fines being carried through the drum by the exhaust gases to meet air pollution requirements.

As indicated above, the burner assembly 40 may be what is considered a combination forced draft and induced draft burner, wherein primary air is supplied by a blower which is part of the burner assembly and secondary air is supplied by the action of the exhaust fan 72. Alternatively, the burner assembly 40 may be a totally forced draft system wherein a blower which is part of the burner assembly supplies primary air and a second blower which is part of the burner assembly supplies the secondary air. With this latter type of totally forced draft burner, the exhaust fan 72 only acts to remove exhaust gases from the drum. The totally forced draft burner system normally has better control over the flame and is helpful in heating the virgin aggregate without burning either the hydrocarbon content of the recycle material being fed into the zone 104 or the asphaltic oil being injected through the nozzle 52.

Changes may be made in the combination and arrangement of parts or elements, as well as in steps or procedures, without departing from the spirit and scope of the invention as defined in the following claims.

What is claimed is:

1. In a method of heating and drying aggregate using a rotating drum having the input end thereof higher than the output end thereof, comprising the steps of:

(a) producing a flame in the drum extending from the input end thereof toward the discharge end thereof;

(b) introducing the aggregate radially into the input end of the drum around the flame;

(c) repeatedly cascading the aggregate through and around a medial portion of the flame as the aggregate gravitates toward the discharge end of the drum; and then (d) repeatedly cascading the aggregate through and around the remaining, terminal portion of the flame entirely across the drum in a higher density of aggregate across the drum than in step (c) as the aggregate continues to gravitate toward the discharge end of the drum.

2. In a method of making hot mix asphalt using a rotating drum having the input end thereof higher than the output end thereof, comprising the steps of:

(a) producing a flame in the drum extending from the input end thereof to a medial portion of the length of the drum;

(b) introducing aggregate radially into the input end of the drum around the flame;

(c) repeatedly cascading the aggregate through and around a medial portion of the flame as the aggregate gravitates toward the discharge end of the drum;

(d) repeatedly cascading the aggregate through and around the remaining, terminal portion of the flame entirely across the drum in a higher density of aggregate across the drum than in step (c) as the aggregate continues to gravitate toward the discharge end of the drum;

(e) injecting asphaltic oil into the drum between the flame and the discharge end of the drum;

(f) mixing the aggregate and asphaltic oil in the remaining portion of the drum as the aggregate continues to gravitate toward the discharge end of the drum to form the hot mix asphalt; and (g) discharging the hot mix asphalt from the discharge end of the drum.

3. The method of claim 2 wherein the mixing of the aggregate and asphaltic oil is accomplished by repeatedly cascading the aggregate with the oil thereon across the drum as the mixture gravitates toward the discharge end of the drum, and wherein in a portion of the drum between the point of entry of asphaltic oil and the discharge end of the drum, the mixture is cascaded entirely across the drum at an increased density for trapping particulate material carried by exhaust gases.

4. The method of claim 2 characterized further to include the steps of feeding particulated, previously laid asphalt mix into a medial portion of the drum between the flame and the discharge end of the drum, and mixing the particulated, previously laid asphalt mix with the aggregate and asphaltic oil while the mixture is gravitated toward the discharge end of the drum.

5. The method of claim 4 wherein the mixing of the particulated, previously laid asphalt mix, the aggregate and the asphaltic oil is accomplished by cascading the mixture across the drum in at least two zones, and wherein in one of said zones the mixture is cascaded entirely across the drum at an increased density for trapping particulate material carried by exhaust gases.

6. The method of claim 5 wherein the increased density cascade zone is adjacent the point of entry of the particulated, previously laid asphalt mix.

7. The method of claim 5 wherein the increased density cascade zone is intermediate the point of entry of the particulated, previously laid asphalt mix and the discharge end of the drum.

8. The method of claim 4 wherein the particulated, previously laid asphalt mix is fed radially into the drum.

9. Apparatus for heating and drying aggregate, comprising:

a drum having an input end and an output end;

means for supporting the drum with the input end thereof higher than the output end thereof;

means for rotating the drum about its longitudinal axis;

means for producing a flame in the drum extending from the input end thereof toward the discharge end thereof;

means for introducing the aggregate radially into the input end of the drum around the flame;

means for repeatedly cascading the aggregate through and around a medial portion of the flame as the aggregate gravitates toward the discharge end of the drum; and means for repeatedly cascading the aggregate through and around the remaining, terminal portion of the flame entirely across the drum in a higher density of aggregate across the drum than performed with the last mentioned means as the aggregate continues to gravitate toward the discharge end of the drum.

10. The apparatus of claim 9 wherein the means for repeatedly cascading the aggregate through and around a medial portion of the flame includes flights secured around the inner periphery of the drum having openings therein, and wherein the means for repeatedly cascading the aggregate through and around the remaining, terminal portion of the flame includes flights secured around the inner periphery of the drum having openings therein larger than the openings in the first mentioned flights.

11. The apparatus of claim 10 wherein each of said flights includes a base portion having an outer edge adjacent the inner periphery of the drum and the remainder thereof extending radially into the drum, said openings being formed in said base portion, and means for securing the outer edge of the base portion to the drum substantially parallel with longitudinal axis of the drum.

12. The apparatus of claim 11 wherein said openings are slots.

13. The apparatus of claim 11 wherein each of said flights further includes a riser portion extending substantially at a right angle from the inner edge of the base portion, and a cup portion extending at an oblique angle from the riser portion, said cup portion having triangular notches therein.

14. The apparatus of claim 13 wherein each of said means for cascading aggregate includes additional flights secured around the inner periphery of the drum between the first mentioned flights, each of said additional flights comprising a solid base portion, a riser portion extending at substantially a right angle from the base portion, and a cup portion extending at an oblique angle from the riser portion.

15. Apparatus for making hot mix asphalt, comprising:

a drum having an input end and an output end;

means for supporting the drum with the input end thereof higher than the output end thereof;

means for rotating the drum about its longitudinal axis;

means for producing a flame in the drum extending from the input end thereof to a medial portion of the length of the drum;

means for introducing aggregate radially into the input end of the drum around the flame;

means for repeatedly cascading the aggregate through and around a medial portion of the flame as the aggregate gravitates toward the discharge end of the drum;

means for repeatedly cascading the aggregate through and around the remaining, terminal portion of the flame in a higher density of aggregate across the drum than is performed with the last mentioned means as the aggregate continues to gravitate toward the discharge end of the drum;

means for injecting asphaltic oil into the drum between the flame and the discharge end of the drum;

means for mixing the aggregate and asphaltic oil in the remaining portion of the drum as the aggregate continues to gravitate toward the discharge end of the drum to form the hot mix asphalt; and means for discharging the hot mix asphalt from the discharge end of the drum.

16. The apparatus of claim 15 wherein:

the means for mixing the aggregate and asphaltic oil comprises means for repeatedly cascading the aggregate with oil thereon across the drum as the mixture gravitates toward the discharge end of the drum, and wherein a portion of the last mentioned means cascades the mixture entirely across the drum at an increased density for trapping particulate material carried by exhaust gases.

17. The apparatus of claim 15 characterized further to include:

means for feeding particulated, previously laid asphalt mix into a medial portion of the drum between the flame and the discharge end of the drum, and said means for mixing the aggregate and asphaltic oil while the mixture is gravitated toward the discharge end of the drum also mixes the particulated, previously laid asphalt mix with the aggregate and asphaltic oil.

18. The apparatus of claim 17 wherein:

said means for mixing the particulated, previously laid asphalt mix, the aggregate and the asphaltic oil includes a first means for cascading the mixture across the drum in one density of the mixture and a second means adjacent the first means for cascading the mixture entirely across the drum at an increased density for trapping particulate material carried by exhaust gases.

19. The apparatus of claim 18 wherein said second means is positioned adjacent the point of entry of the particulated, previously laid asphalt mix into the drum.

20. The apparatus of claim 18 wherein the second means is positioned intermediate the point of entry of the particulated, previously laid asphalt mix into the drum and the discharge end of the drum.

21. The apparatus of claim 17 wherein the means for feeding particulated, previously laid asphalt mix into the medial portion of the drum comprises means for feeding the particulated, previously laid asphalt mix radially into the drum.

* * * * *

UNITED STATES PATENT OFFICE

CERTIFICATE OF CORRECTION

Patent No. 4,174,181 Dated November 13, 1979

Inventor(s) David L. Garbelman, William H. Minor and Arthur G. Shaw

It is certified that error appears in the above-identified patent and that said Letters Patent are hereby corrected as shown below:

Front page under Assignee, "Oklahomo" should be --Oklahoma--.

Column 1, line 45, "7/8" should be --1/3--.

Column 5, line 66, "pots" should be --ports--.

Column 6, line 4, "shown" should be --known--.

Column 6, line 18, "portion" should be --portions--.

Column 6, line 65, "discussed" should be --displaced--.

Column 14, line 43, "coonventional" should be --conventional--.

Signed and Sealed this

*Eighteenth* Day of *March 1980*

[SEAL]

*Attest:*

SIDNEY A. DIAMOND

*Attesting Officer*

*Commissioner of Patents and Trademarks*